US007731180B2

(12) United States Patent
Ohnishi

(10) Patent No.: US 7,731,180 B2
(45) Date of Patent: Jun. 8, 2010

(54) SHEET-FEEDING CASSETTE AND IMAGE FORMING APPARATUS

(75) Inventor: Yuzo Ohnishi, Osaka (JP)

(73) Assignee: Kyocera Mita Corporation (JP)

( * ) Notice: Subject to any disclaimer, the term of this patent is extended or adjusted under 35 U.S.C. 154(b) by 28 days.

(21) Appl. No.: 12/044,330

(22) Filed: Mar. 7, 2008

(65) Prior Publication Data

US 2008/0237972 A1 Oct. 2, 2008

(30) Foreign Application Priority Data

Mar. 28, 2007 (JP) ..... 2007-085045

(51) Int. Cl.
*B65H 1/22* (2006.01)

(52) U.S. Cl. ..... 271/164; 271/162; 271/145

(58) Field of Classification Search ..... 271/162, 271/164, 145; 399/393; 312/332.1
See application file for complete search history.

(56) References Cited

U.S. PATENT DOCUMENTS 4,966,356 A * 10/1990 Ohyabu et al. ..... 271/9.11
5,413,409 A * 5/1995 Arai ..... 312/330.1
5,918,875 A * 7/1999 Masley et al. ..... 271/162
6,340,212 B1 * 1/2002 Beiss et al. ..... 312/223.3
2005/0269764 A1 12/2005 Lee et al.
2007/0177915 A1 * 8/2007 Motoyoshi ..... 399/393

FOREIGN PATENT DOCUMENTS

JP 2006-76695 3/2006

* cited by examiner

*Primary Examiner*—Patrick Mackey
*Assistant Examiner*—Jeremy Severson
(74) *Attorney, Agent, or Firm*—Gerald E. Hespos; Michael J. Porco

(57) ABSTRACT

A sheet-feeding cassette includes a main body. A locked portion allows the main body to be locked to a locking portion in a cassette accommodating section by inserting the main body in the cassette accommodating section. An unlocking unit is provided for detaching the locked portion from the locking portion when the main body is drawn out of the cassette accommodating section. A handle is provided in the main body and includes fixed and movable grips. The fixed grip has a recess with a "]" shaped cross section open to the insertion direction. The movable grip is slidable to a fitted state in the recess of the fixed grip when the handle is gripped, and a projecting state projecting partially from the recess when gripping is released. The unlocking unit operates for unlocking in accordance with changing of states of the movable grip from the projecting state to the fitted state.

5 Claims, 19 Drawing Sheets

SHEET-FEEDING CASSETTE AND IMAGE FORMING APPARATUS

BACKGROUND OF THE INVENTION

1. Field of the Invention

The present invention relates to image forming apparatuses such as a copying machine, a facsimile machine, and a printer and a sheet-feeding cassette for feeding a sheet to such image forming apparatuses.

2. Description of the Related Art

An image forming apparatus like those described above is provided with a locking structure which locks a sheet-feeding cassette when the sheet-feeding cassette is set in a cassette accommodating section of the image forming apparatus, and unlocks the sheet-feeding cassette when the sheet-feeding cassette is drawn out of the cassette accommodating section.

As an example of the locking structure, Japanese Patent Unexamined Publication No. 2006-76695 (hereinafter, referred to as "patent document 1") discloses a known locking structure which is provided with a locking pin in a cassette accommodating section of an image forming apparatus, a pivotal locking lever locked by the locking pin on a side of the sheet-feeding cassette, and a spring for retaining the locking lever to be locked to the locking pin.

According to this locking structure, the locking lever is locked to the locking pin by the spring when the sheet-feeding cassette is set in the cassette accommodating section. The locking lever is pivotally moved apart from the locking pin against the spring by a drawing force, so that the locking structure is unlocked when the sheet-feeding cassette is drawn out of the cassette accommodating section.

Thus, when unlocking is performed with the technology disclosed in the patent document 1, a large amount of force is required which includes a force for drawing the sheet-feeding cassette out of the cassette accommodating section and a force for pivotally moving the locking lever so as to detach the locking lever from the locking pin against the spring. Therefore, room for improvement in operability has been left. Further, there has been a disadvantage that a loud sound occurs when the locking lever is moved back by the spring after the locking lever is detached from the locking pin.

The present invention was made to solve the problems of the conventional technology, and its object is to provide a sheet-feeding cassette and an image forming apparatus capable of performing unlocking without need for a large amount of force and without occurrence of a loud sound.

SUMMARY OF THE INVENTION

According to an aspect of the present invention, a sheet-feeding cassette includes a sheet-feeding cassette which is slidably provided in a cassette accommodating section of an image forming apparatus, and set by being inserted in an insertion direction toward the cassette accommodating section, and supplied with a sheet by being drawn out of the cassette accommodating section in a drawing direction which is opposite to the insertion direction, and the sheet-feeding cassette comprises: a sheet-feeding cassette main body drawn out in the drawing direction so that the sheet is supplied; a locked portion for allowing the sheet-feeding cassette main body to be locked to a locking portion provided in the cassette accommodating section by insertion of the sheet-feeding cassette main body to the cassette accommodating section; an unlocking unit for detaching the locked portion locked to the locking portion when the sheet-feeding cassette main body is drawn out of the cassette accommodating section; a handle provided at a downstream end of the sheet-feeding cassette main body in the drawing direction, the handle including: a grip portion which is to be gripped by a user with a hand; the grip portion having: a fixed grip portion having an open recess which is open to the insertion direction and having a "]" shaped cross section; and a movable grip portion so provided as to be slidable to a fitted state of being fitted in the opening recess of the fixed grip portion when the grip portion is gripped, and to a projecting state of partially projecting from the opening recess when gripping of the grip portion is loosened or released. The unlocking unit operates for unlocking in accordance with changing of states of the movable grip portion from the projecting state to the fitted state.

In a case of the sheet-feeding cassette and the image forming apparatus so configured as described above according to an aspect of the present invention, the movable grip portion slides from the projected state of partially projecting from the opening recess of the fixed grip portion to the fitted state of being fitted in the opening recess when the grip portion of the handle is gripped. In accordance with the sliding, the unlocking unit is activated so that the locked portion falls into an unlocked state with respect to the locking portion provided in the cassette accommodating section. Accordingly, unlocking is completed. Thereafter, if a drawing force is applied to the sheet-feeding cassette, the sheet-feeding cassette is drawn. Therefore, since respective timings of applying a force needed for unlocking and a drawing force are different from one another, a large amount of force would not be necessary when the sheet-feeding cassette is drawn. Further, moving back the movable grip portion slowly causes a loud sound not to occur at the time of unlocking.

These and other objects, features and advantages of the present invention will become more apparent upon reading of the following detailed description along with the accompanied drawings.

DETAILED DESCRIPTION OF THE PREFERRED EMBODIMENTS

Hereinafter, the present invention will be described specifically.

First Embodiment

Figure 1:
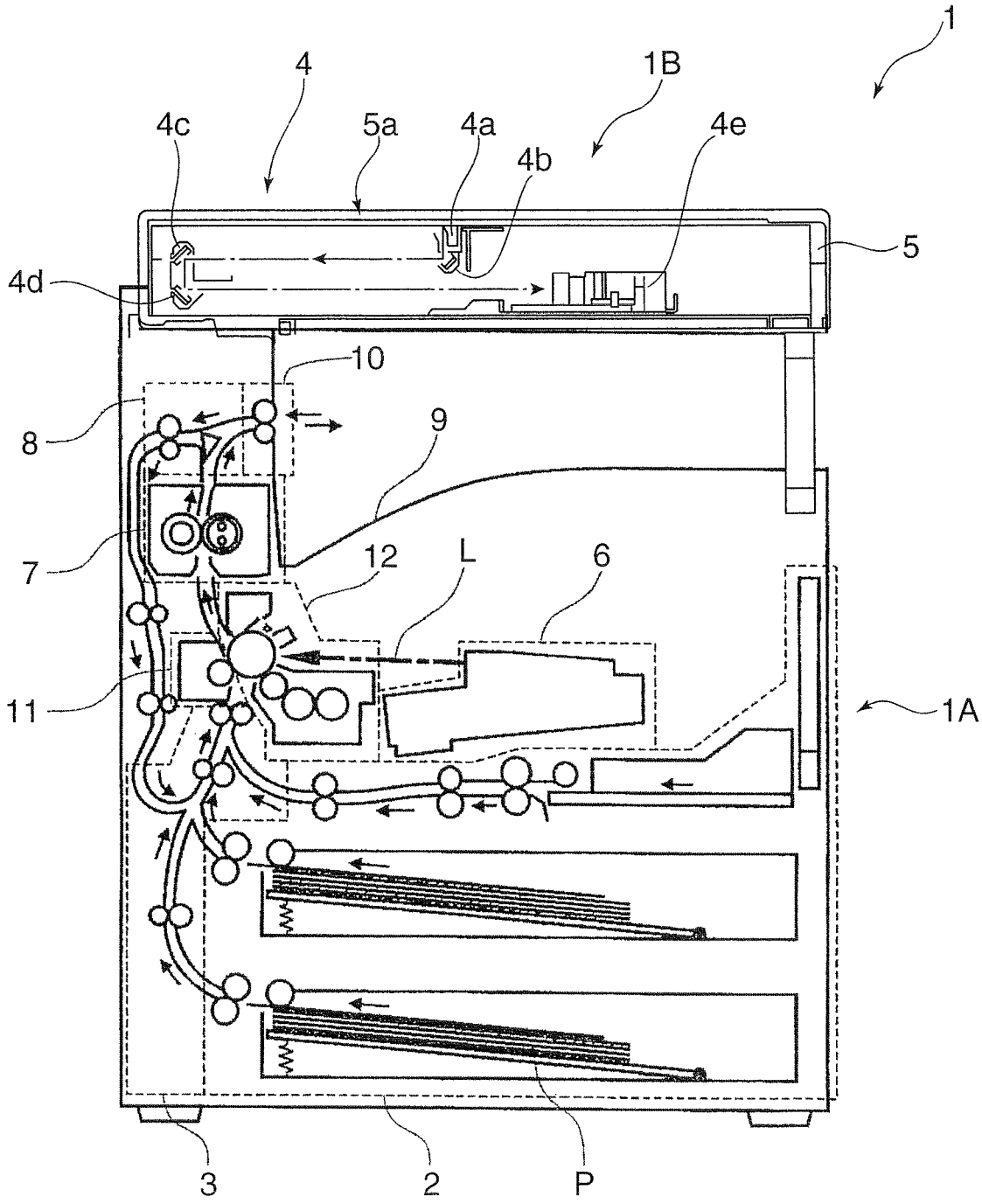
FIG. 1 is a front sectional view schematically showing an image forming apparatus in accordance with a first embodiment of the present invention.

FIG. 1 is a front sectional view schematically showing an image forming apparatus in accordance with a first embodiment of the present invention. Solid line arrows in the drawing show a conveying path and a convey direction of a sheet, and a one-dotted chain line arrow shows a laser light L.

An image forming apparatus 1 is provided with an image forming apparatus main body 1A at its lower portion, and an image reading section 1B at its upper portion, and has a basic configuration in which the image forming apparatus main body 1A forms a toner image in accordance with image data read by the image reading section 1B and transfers the toner image onto a sheet P.

The image forming apparatus main body 1A has a sheet-feeding section 2 at its lower portion. In the sheet-feeding section 2, sheets P such as cut papers before printing are stored in a stack, and the sheets P are separated and sent out one after another.

In the image forming apparatus main body 1A and on left of the sheet-feeding section 2, there is provided a sheet conveying passage 3. The sheet P sent out from the sheet-feeding section 2 is conveyed vertically upward along a side surface of the image forming apparatus 1 through the sheet conveying passage 3, and reaches a transferring section 11 which will be described hereinafter.

On the other hand, in the image reading section 1B provided on an upper side of the image forming apparatus main body 1A, there is provided an optical system unit 4 for reading image data of a document placed on a document holding surface formed in an upper surface of the image reading section 1B. The optical system unit 4 has a light source 4*a*, a plurality of, for example, three mirrors 4*b*, 4*c*, 4*d* for changing directions of light outgoing from the light source 4*a* and reflected from the document, and a CCD 4*e* for reading image data of the document through the mirrors 4*b* through 4*d*. Then, information of image data read by the image reading section 1B is sent to a laser irradiating section 6 which is arranged above the sheet-feeding section 2 and at a central portion in the image forming apparatus main body 1A. The laser irradiating section 6 irradiates the laser light controlled in accordance with image data to an image forming section 12 which will be described hereinafter.

At a position above the sheet conveying passage 3 and on left of the laser irradiating section 6, there are provided the image forming section 12 and the transferring section 11. In the image forming section 12, the laser light L irradiated by the laser irradiating section 6 forms an electrostatic latent image of a document image. A toner image is developed from the electrostatic latent image, and the toner image is transferred onto a recording sheet to be printed which is conveyed through the sheet conveying passage 3 in synchronization.

Above the transferring section 11, there is provided a fixing section 7. The sheet P bearing a non-fixed toner image from the transferring section 11 is conveyed to the fixing section 7, and the toner image is heated, melted, and fixed by a heat roller.

Above the fixing section 7, there is provided a branching section 8. The sheet P discharged from the fixing section 7 is discharged from the branching section 8 to the sheet-discharging tray 9 formed in the main body of the image forming apparatus 1 when both-side printing is not performed.

A sheet-discharging slot through which the sheet P is conveyed from the branching section 8 to the sheet-discharging tray 9 serves as a switch-back section 10. When the both-side printing is performed, a conveying direction of the sheet P discharged from the fixing section 7 is changed at this switch-back section 10. Then, the sheet P is conveyed downward on left side of the fixing section 7 and the transferring section 11, and conveyed to the transferring section 11 through the sheet conveying passage 3 again.

Figure 2:
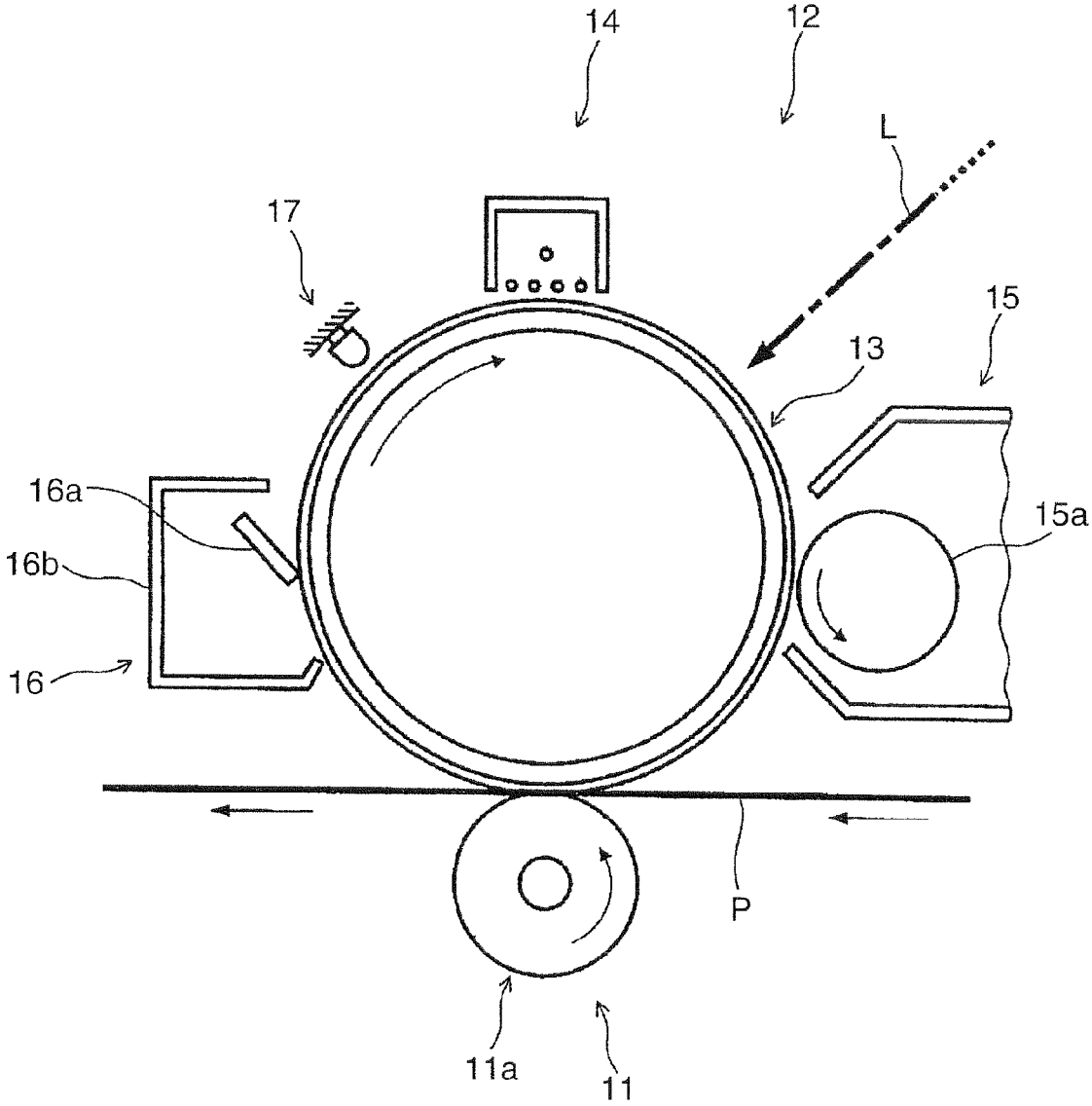
FIG. 2 shows details of a vicinity of an image forming section.

FIG. 2 shows details of a vicinity of the image forming section 12. FIG. 2 is so depicted that a sheet convey direction becomes horizontal, and parts which can be omitted for description of the invention are omitted.

The image forming section 12 is provided with a photoconductive drum 13, which is an image bearing member, at its center. In a vicinity of the photoconductive drum 13, there are provided a charging device 14, a developing device 15, a cleaning device 16, and a charge-removing device 17 sequentially in a rotational direction.

The photoconductive drum 13 has a surface which is uniformly charged by the charging device 14 at a predetermined polarity and electric potential. To the photoconductive drum 13 in such state, a laser light L which is controlled by the laser irradiating section 6 is irradiated in accordance with image data read by the image reading section 1B. Then, electric potential at the irradiated part is reduced, so that an electrostatic latent image of a document image is formed. Then, toners charged in the developing device 15 are supplied to the surface of the developing roller 15*a*, so that a toner image is formed from the electrostatic latent image.

On the other hand, the sheet P is conveyed by the sheet conveying passage 3 (refer to FIG. 1) in synchronization with forming of a toner image on the surface of the photoconductive drum 13 and passes through a transfer nip portion which is formed by contact between the photoconductive drum 13 and the transferring roller 11*a*. At this time, a transfer bias of negative polarity, which is inversed polarity with respect to polarity of the photoconductive drum 13 and toners, is applied to the transferring roller 11*a*. This moves toners from the photoconductive drum 13 to the transferring roller 11*a*, so that the toner image is transferred to the sheet P.

After the toner image is transferred, toners remaining on the surface of the photoconductive drum 13 is scraped off and removed by a cleaning blade 16*a* provided in the cleaning device 16. The toners collected into a housing 16*b* provided in the cleaning device 16 are conveyed to outside of the cleaning device 16 by a screw (not illustrated).

After the toners on the surface of the photoconductive drum 13 are cleaned, the charge-removing device 17 removes electrical charge from the surface of the photoconductive drum 13, so that preparation for the next image forming operation is made.

Figure 3:
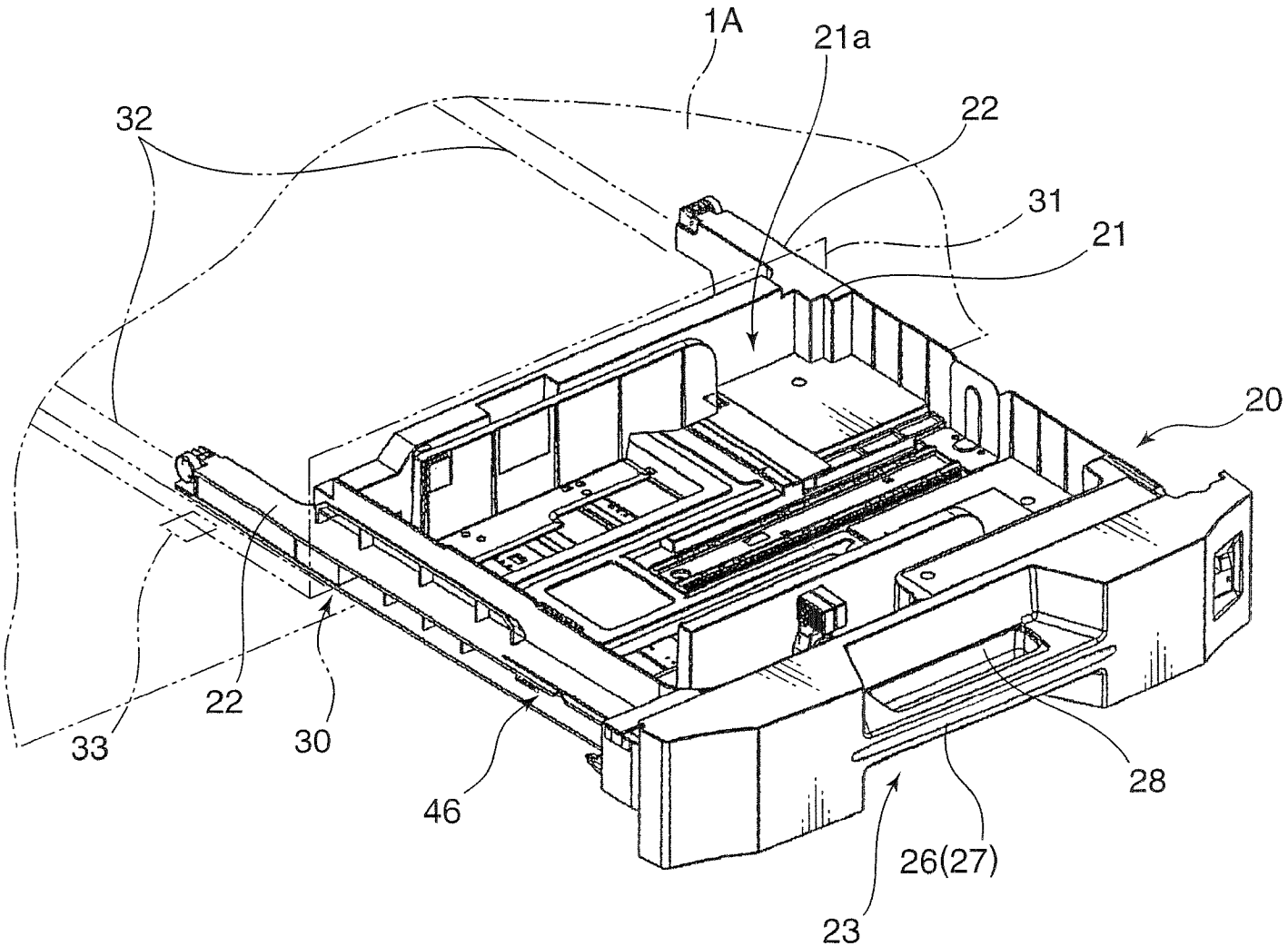
FIG. 3 is a perspective view showing a sheet-feeding cassette which is set in a cassette accommodating section of a sheet-feeding section.

FIG. 3 is a perspective view showing a sheet-feeding cassette which is set in a cassette accommodating section of a sheet-feeding section. In FIG. 1, an example is shown which includes upper and lower cassette accommodating sections and upper and lower sheet-feeding cassettes set in the cassette accommodating sections respectively. However, the upper cassette accommodating section and the upper sheet-feeding cassette have the same configuration as those of the lower cassette accommodating section and the lower sheet-feeding cassette, respectively. Therefore, in the following description, only configurations of the cassette accommodating section and the sheet-feeding cassette on the lower side will be described.

The sheet-feeding cassette 20 is provided slidably in the cassette accommodating section 30 which is provided in a lower portion of the image forming apparatus main body 1A. The sheet-feeding cassette 20 is set by inserting the same in an insertion direction heading toward an inner back portion of the cassette accommodating section 30. The sheet P is supplied to the sheet-feeding cassette 20 when the sheet-feeding cassette 20 is drawn from the cassette accommodating section 30 in a drawing direction which is opposite to the insertion direction.

The cassette accommodating section 30 is a part of an opening 31 which is formed in a front side of the image forming apparatus main body 1A. The cassette accommodating section 30 includes a pair of guiding members 32 which are provided at inner parts of an opening 31 and on left and right opposite sides in the opening 31. In a vicinity of the guiding member 32 on one side (for example, left side), there is provided a locking portion 33. Each of the guiding members 32 is adapted to guide the sheet-feeding cassette 20. The locking portion 33 is adapted to retain a state where the sheet-feeding cassette 20 is set at a set position. For example, the locking portion 33 is so configured that it has a predetermined maximum projecting length, and projects in a rightward direction or enters in a leftward direction by an elastic force of an unillustrated a spring 33S which is provided on left side of the locking portion 33.

The sheet-feeding cassette 20 has a sheet-feeding cassette main body 21, a pair of guided members 22, a handle 23, a locked portion 46, and an unlocking unit 40. The sheet-feeding cassette 20 has a sheet accommodating portion 21*a* at its substantially central portion. The a pair of guided member 22 are provided respectively on left and right sides across the sheet accommodating portion 21*a*. The handle 23 is provided on a front side of the sheet accommodating portion 21*a*. The locked portion 46 is locked by a locking portion 33 provided in the cassette accommodating section 30. The unlocking unit 40 is adapted to unlock a locked state where the locked portion 46 is locked by the locking portion 33. The unlocking unit 40 will be described hereinafter.

The pair of guided members 22 project outwardly in leftward and rightward directions and are guided in forward and backward direction in a state of being placed on upper sides of the pair of guiding members 32 projecting toward inside of the cassette accommodating section 30.

The handle 23 has a grip portion 26 which is to be gripped with a hand. The grip portion 26 has a fixed grip portion 27 and a movable grip portion 28, which will be described hereinafter, provided inside of the fixed grip portion 27.

Figure 4:
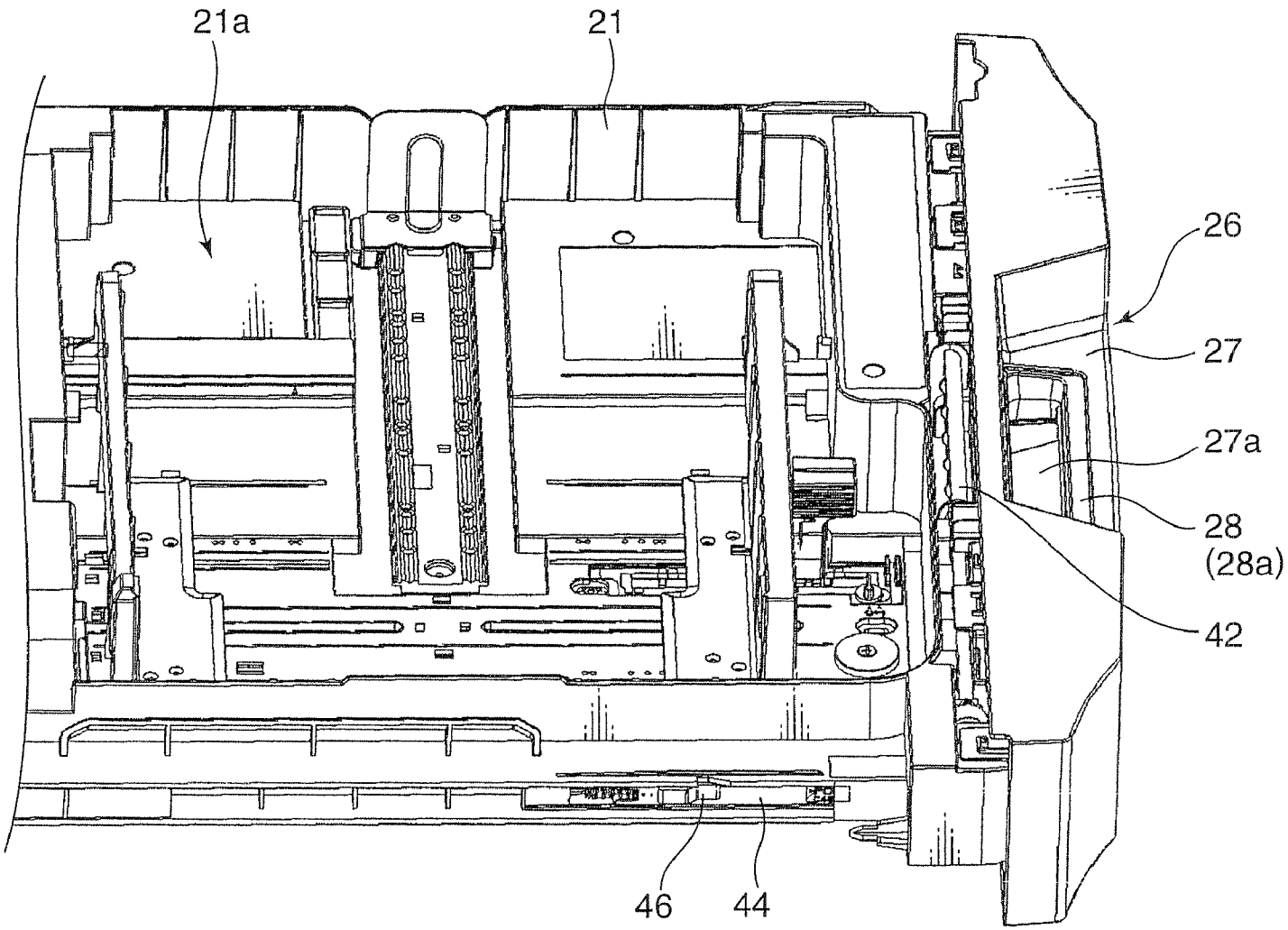
FIG. 4 shows the sheet-feeding cassette viewed from an upper oblique left direction, and shows a state before a movable grip portion is gripped.
Figure 5:
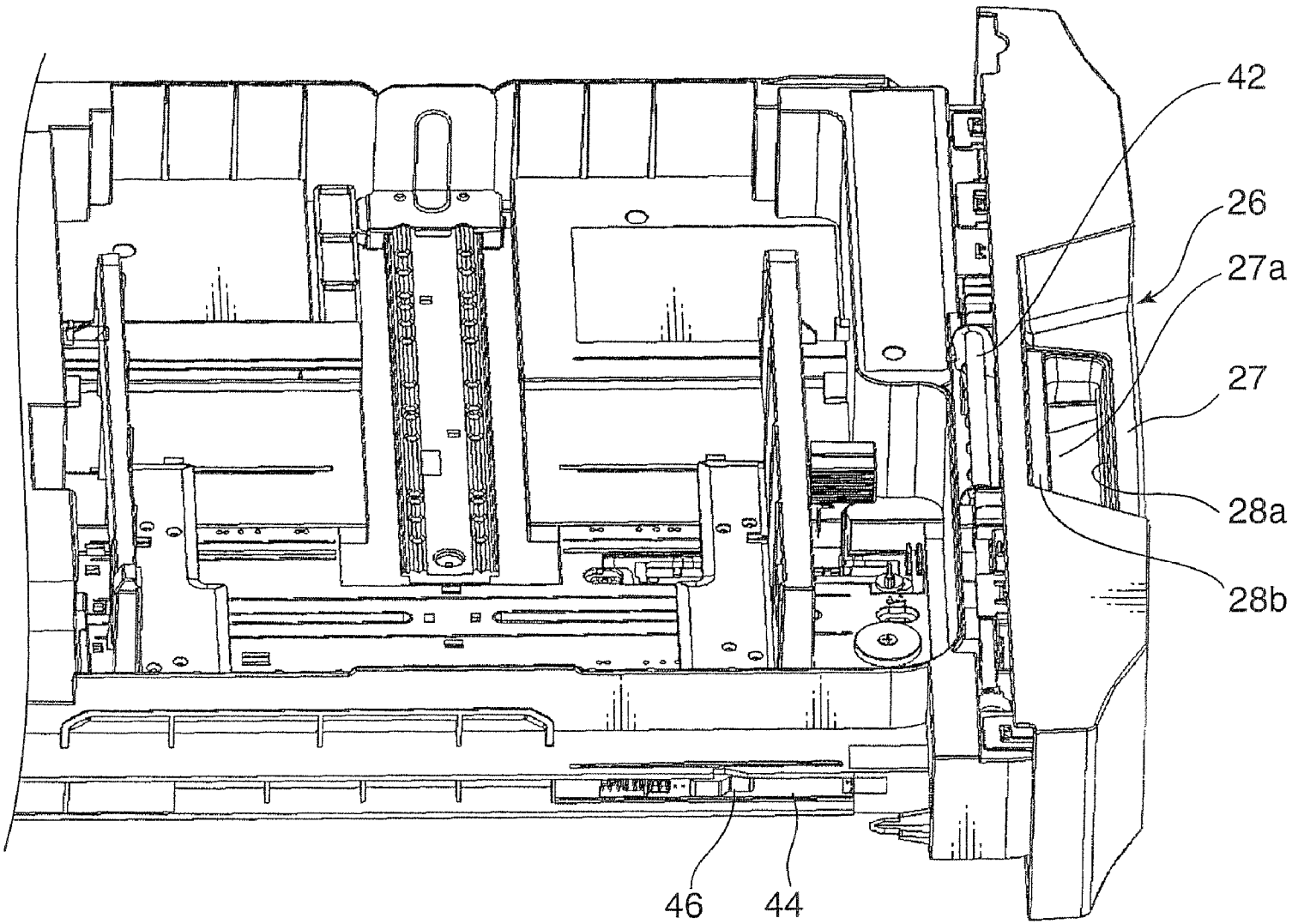
FIG. 5 shows the sheet-feeding cassette viewed from an upper oblique left direction, and shows a state where the movable grip portion is gripped.
Figure 6:
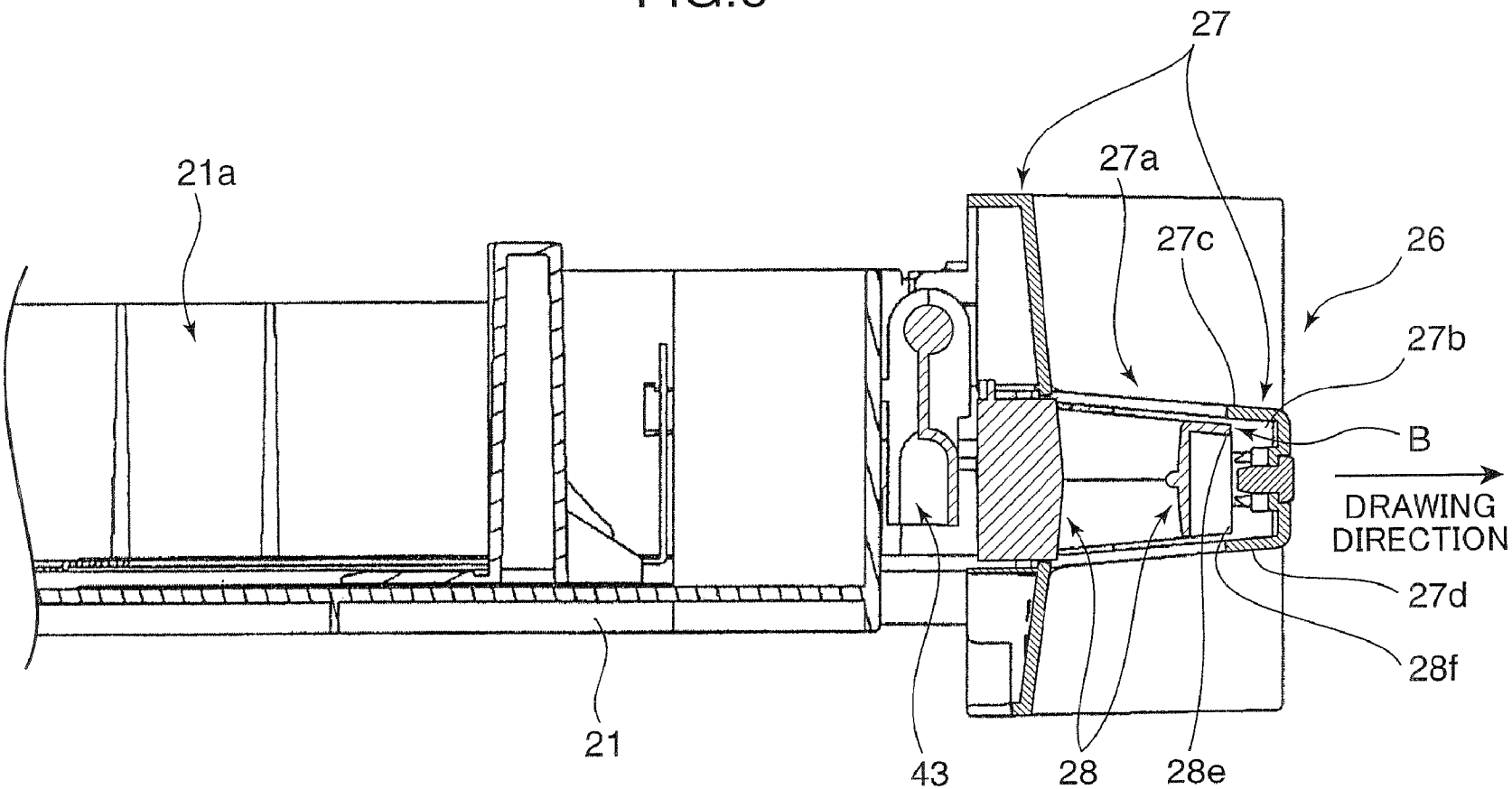
FIG. 6 is a sectional view showing a vicinity of the grip portion, and shows a state before the movable grip portion is gripped.
Figure 7:
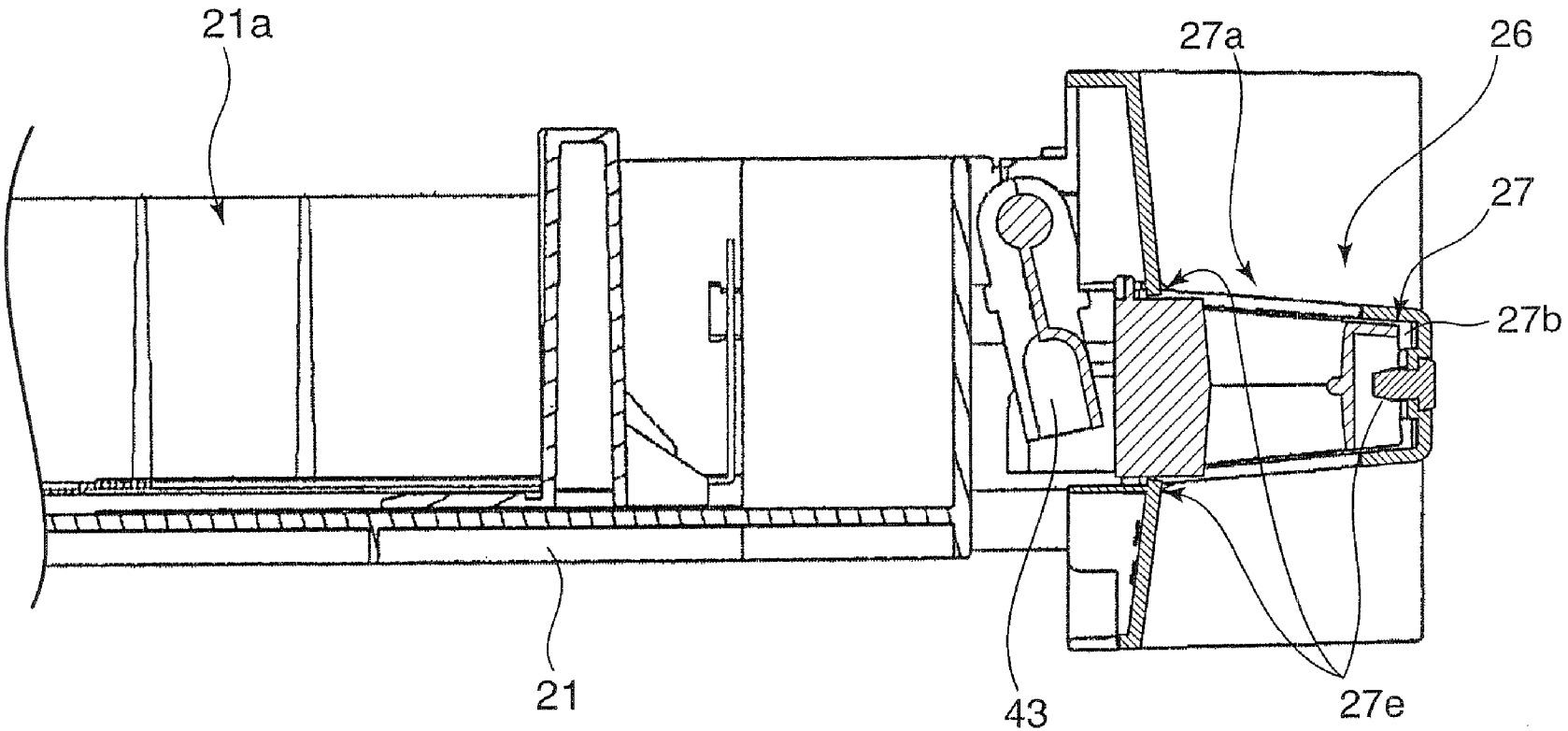
FIG. 7 is a sectional view showing a vicinity of the grip portion, and shows a state where the movable grip portion is gripped.
Figure 8:
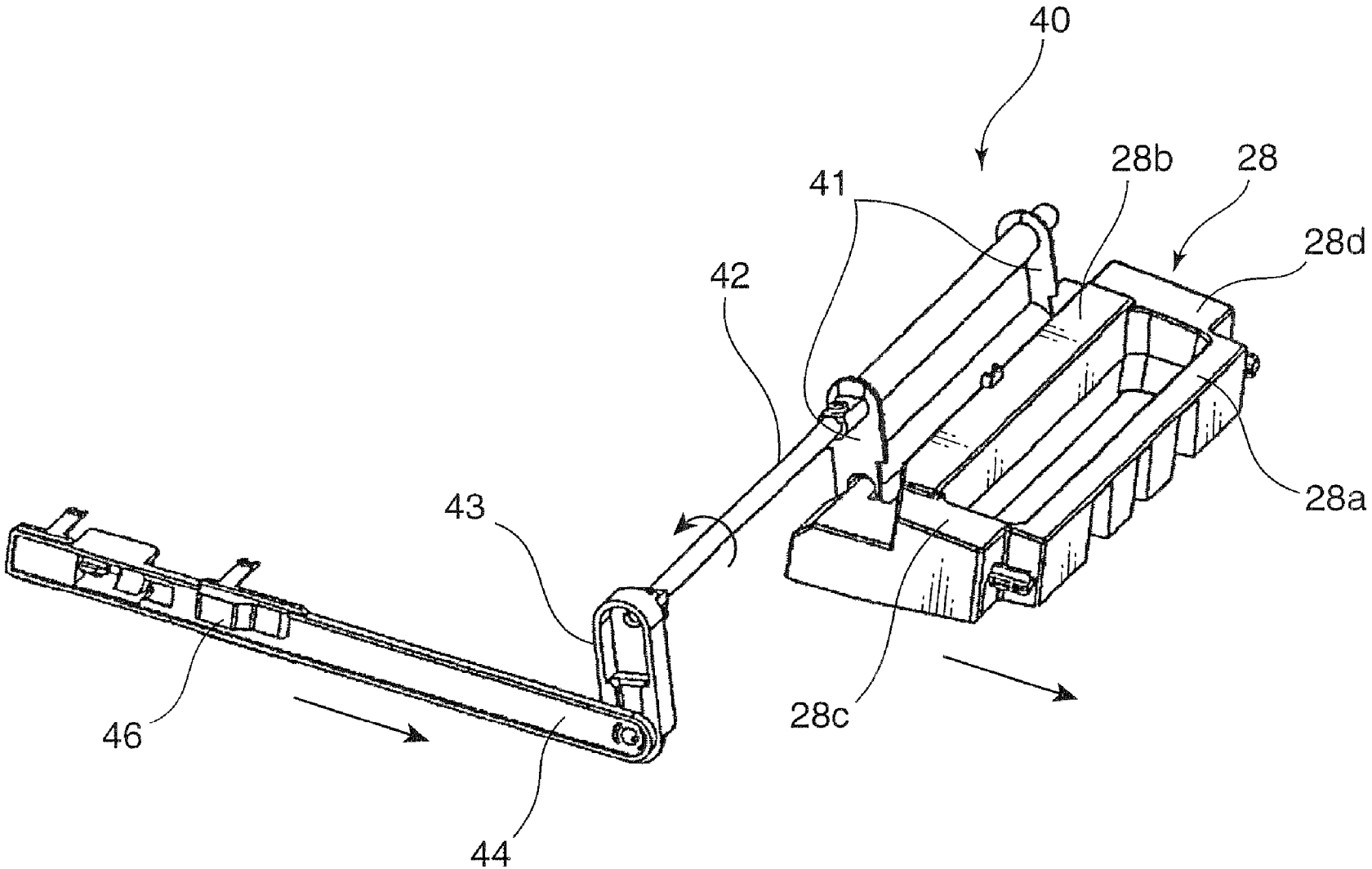
FIG. 8 is a perspective view showing an unlocking unit connected to the movable grip portion.
Figure 9:
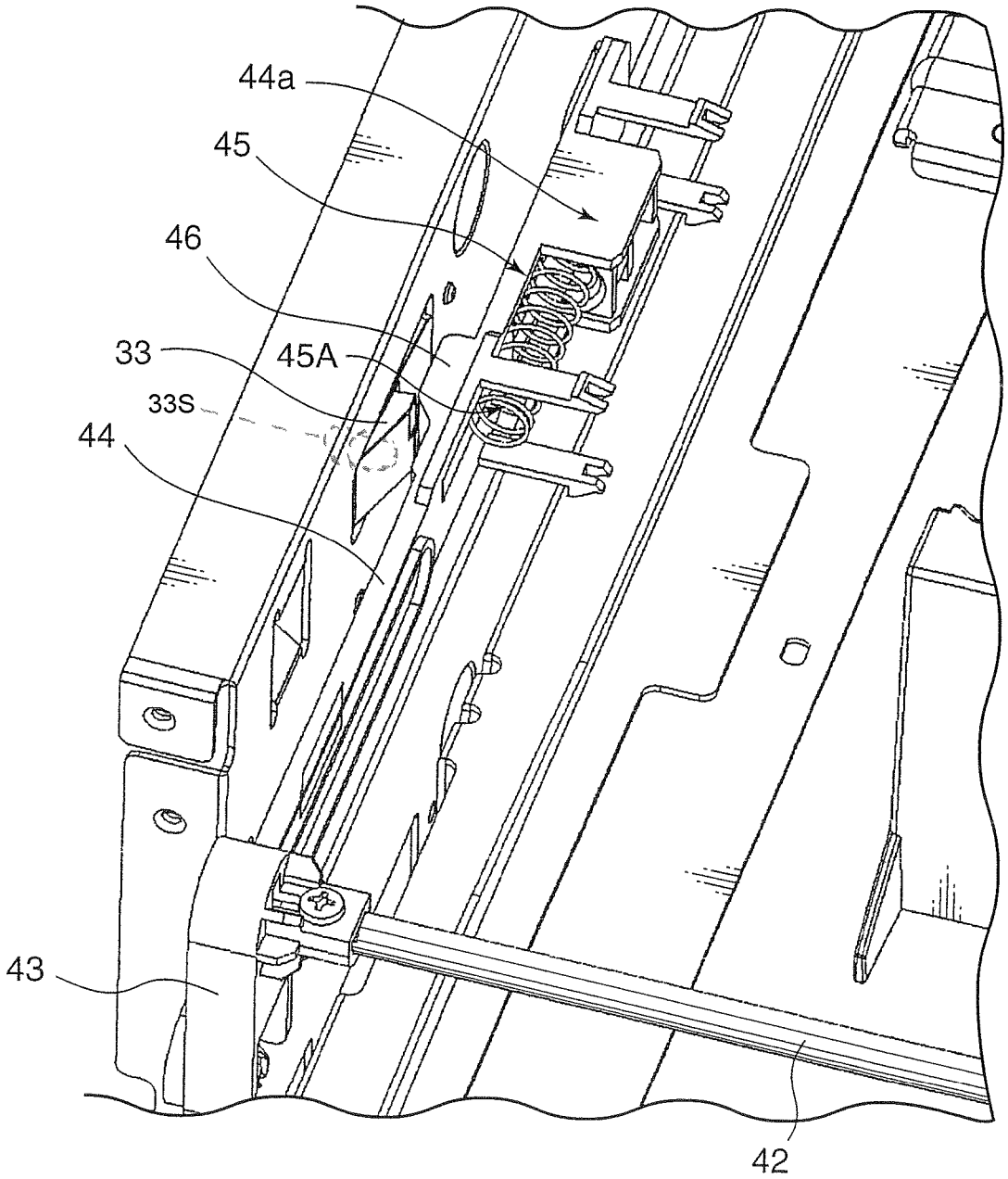
FIG. 9 is a perspective view showing a part of the unlocking unit, and shows a state before the movable grip portion is gripped.
Figure 10:
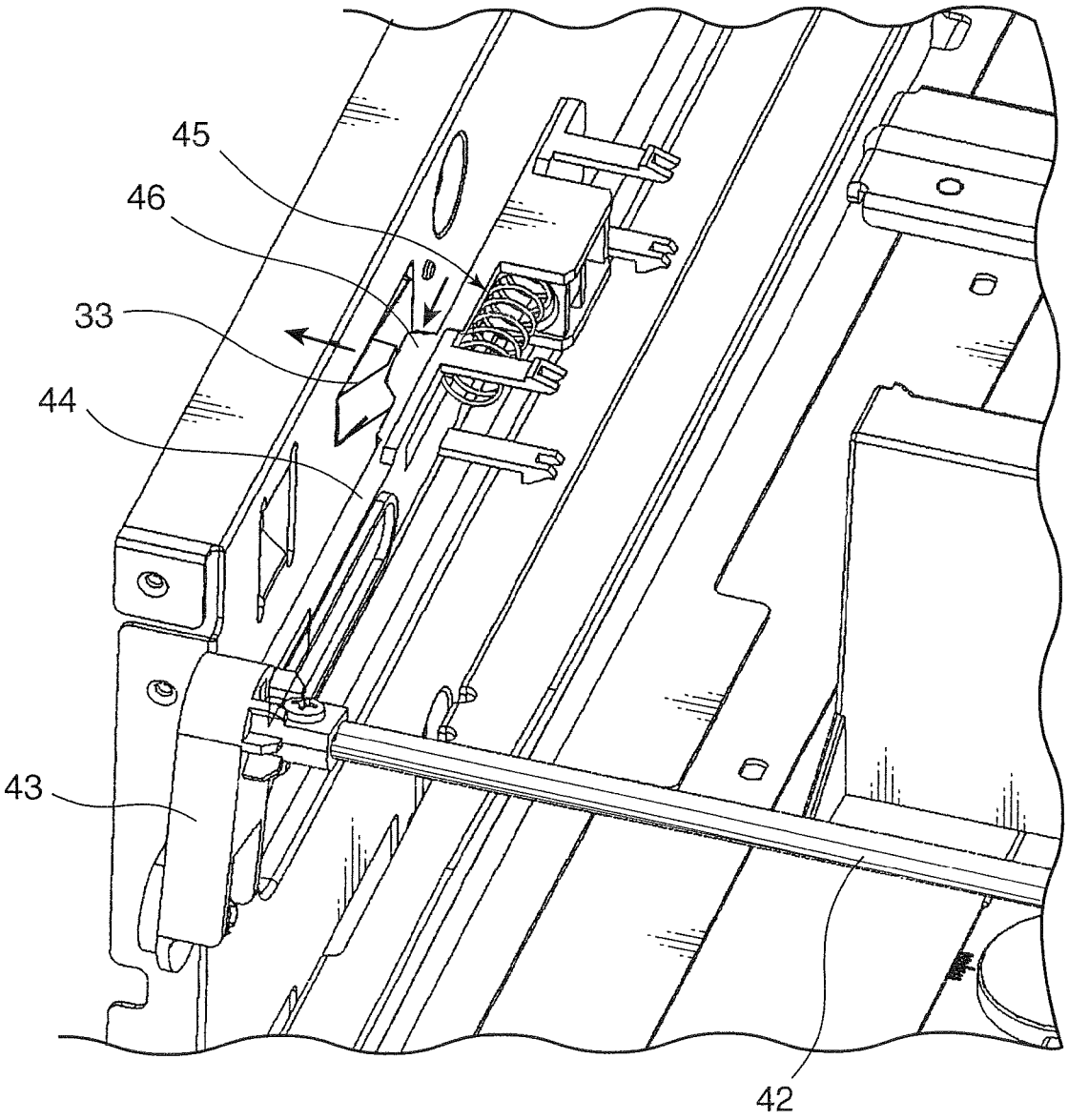
FIG. 10 is a perspective view showing a part of the unlocking unit, and shows a state where the movable grip portion is gripped.
Figure 11:
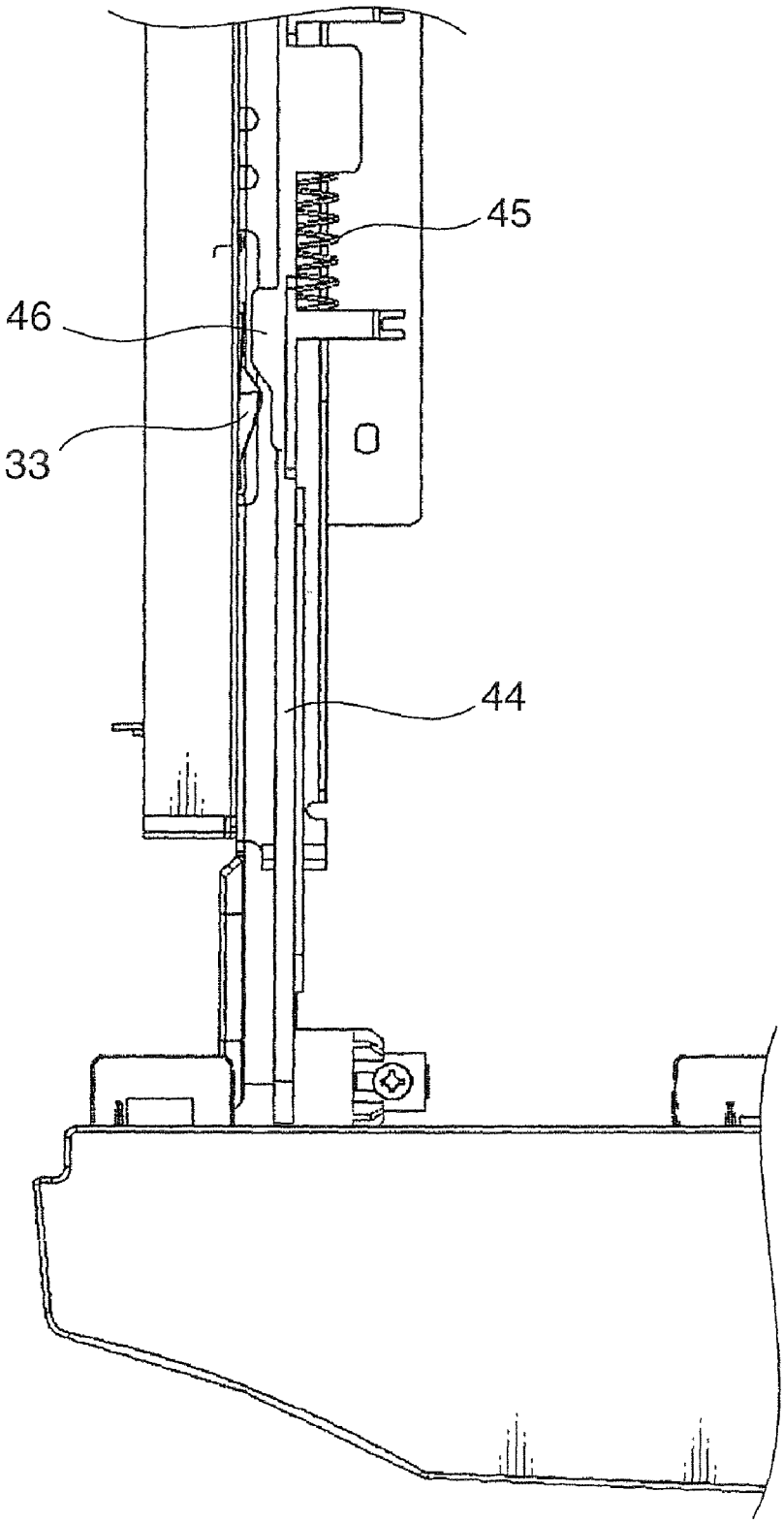
FIG. 11 is a plan view showing a part of the unlocking unit, and shows a state where a state before the movable grip portion is gripped.
Figure 12A:
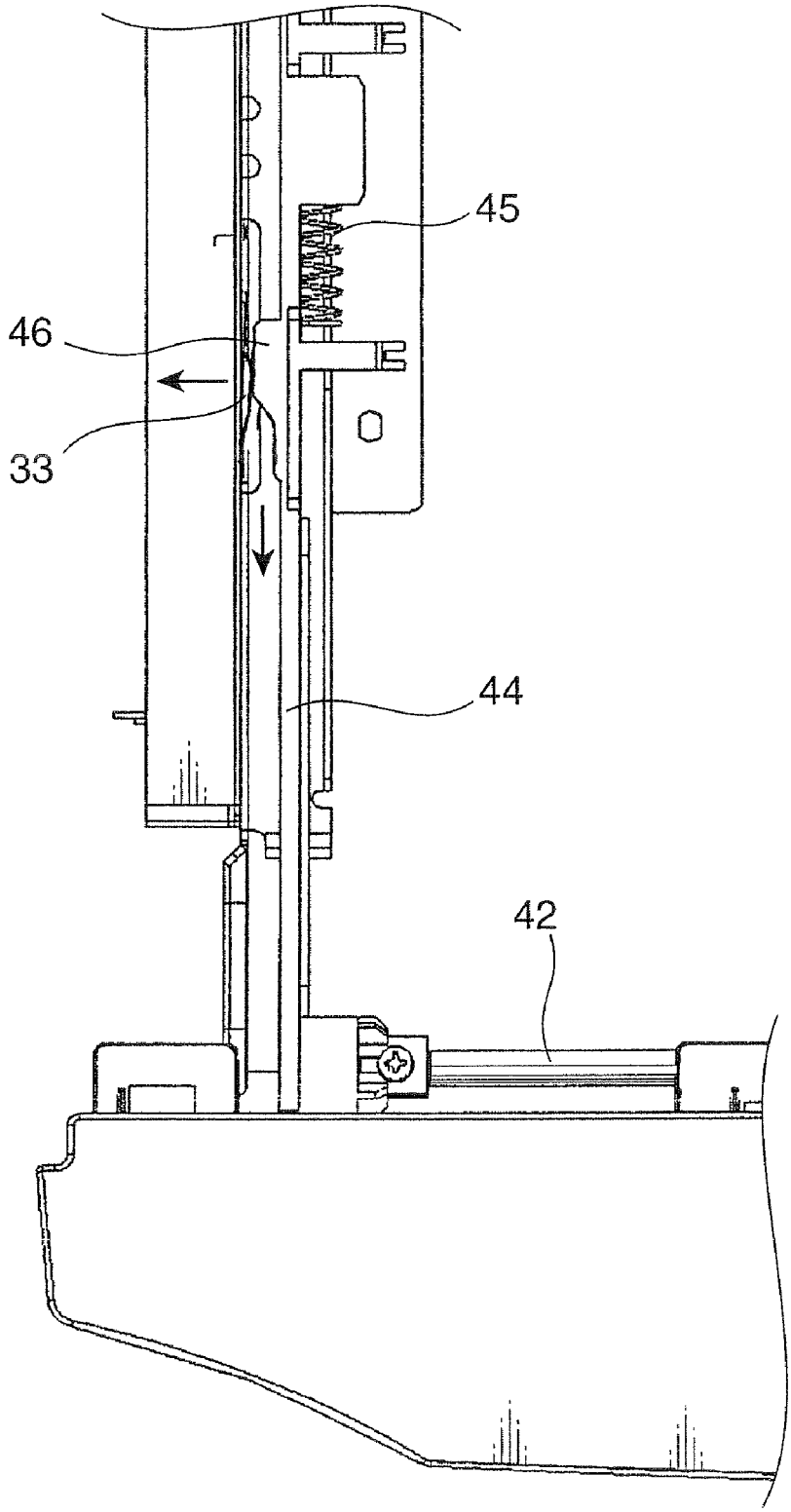
FIG. 12A is a plan view showing a part of the unlocking unit, and shows a state where the movable grip portion is gripped.

FIGS. 4 and 5 show the sheet-feeding cassette 20 viewed from an upper oblique left direction, and FIGS. 6 and 7 are sectional views showing a vicinity of the grip portion 26. FIGS. 4 and 6 show a state before the movable grip portion 28 is gripped. FIGS. 5 and 7 show a state where the movable grip portion 28 is gripped. Further, FIG. 8 is a perspective view showing the unlocking unit 40 connected to the movable grip portion 28. FIGS. 9 and 10 are perspective views showing states of unlocking operation with the unlocking unit 40. FIGS. 11 and 12A are plan views showing states of the same unlocking operation. FIGS. 9 and 11 show the state before the movable grip portion 28 is gripped. FIG. 10 and FIG. 12 show the state where the movable grip portion 28 is gripped.

In the fixed grip portion 27, an opening 27*a* is formed in a widthwise central portion on the front side of the exterior cover for allowing a user to insert fingers other than a thumb, for example. A user puts his fingers other than a thumb to the opening 27*a*, so that the grip portion 26 can be gripped between a thumb and other fingers.

Further, the fixed grip portion 27 is so formed as to have a "]" shape cross section having an opening recess 27*b* which is open toward a direction of inserting the sheet-feeding cassette 20, and the opening recess 27*b* is in communication with the opening 27*a*. Note where the term said "]" shape cross section used in this specification and in claims is meant to be a cross sectional shape that looks like a right square bracket (or left square bracket).

The movable grip portion 28 is so formed as to have a ring-like shape which is substantially a rectangular shape. The movable grip portion 28 has a front long side portion 28*a*, a rear long side portion 28*b*, a left short side portion 28*c*, and a right short side portion 28*d*. The movable grip portion 28 so configured as described above is mounted in an inner side of the opening recess 27*b* of the fixed grip portion 27 in such a manner as to be slidable in forward and backward directions. When the grip portion 26 is gripped, a state of the grip portion 26 changes from a projecting state, in which a part of the front long side portion 28*a* projects from the opening 27*a* as shown in FIG. 4, to a fitted state, in which the front long side portion 28*a* is fitted in the fixed grip portion 27 as shown in FIG. 5. When gripping is loosened or released, a state of the grip portion 26 changes back to the projecting state.

Figure 12B:
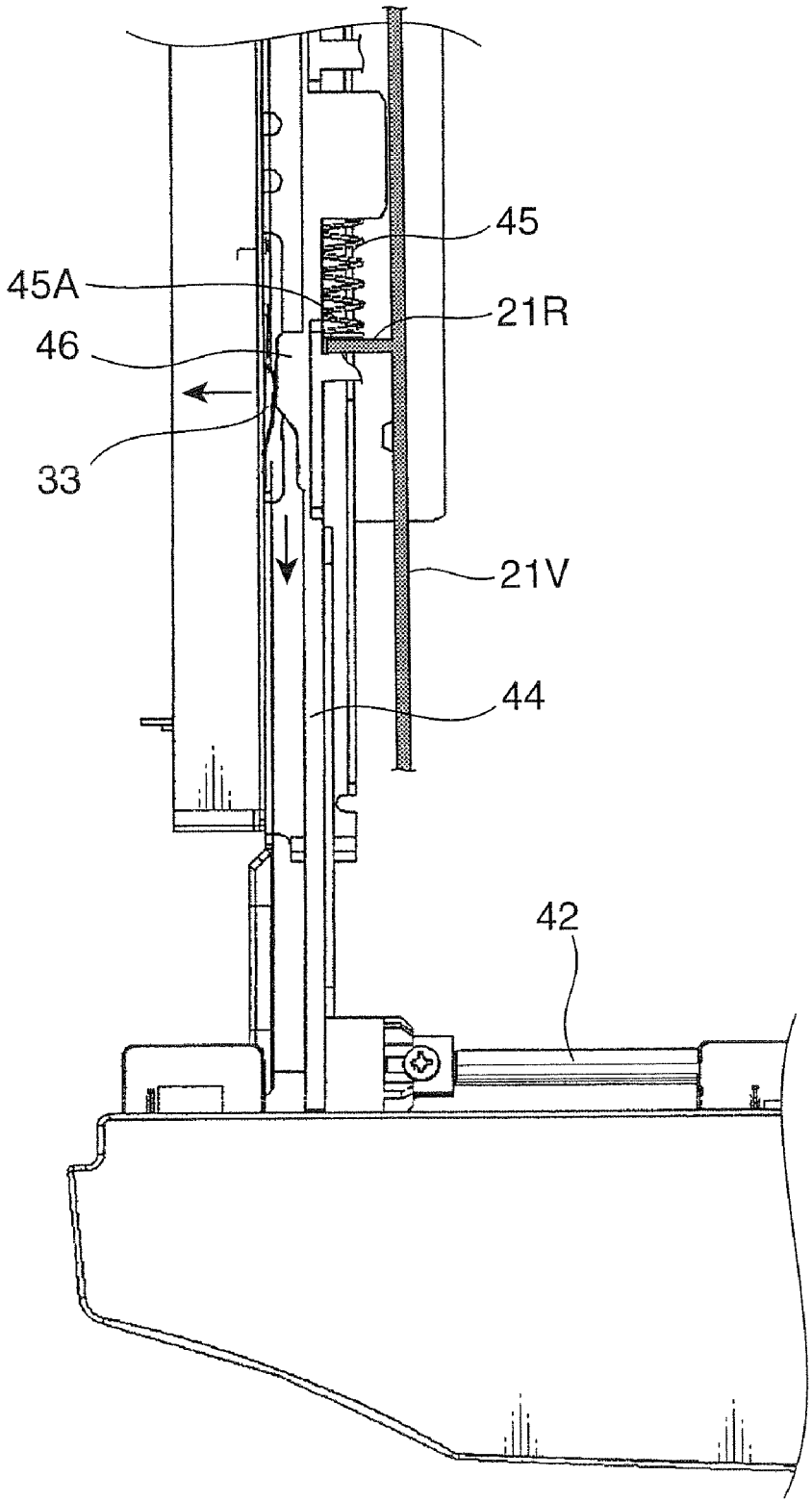
FIG. 12B shows a state of contact between an end portion of a coil spring in an unlocked state and a sheet-feeding cassette.

Then, the motion of the movable grip portion 28 allows the unlocking unit 40 to be activated. As shown in FIG. 8, the unlocking unit 40 includes a pair of links 41 each having one end rotatably connected to the rear long side portion 28*b* of the movable grip portion 28, a rotational shaft 42 to which the other end of each link 41 is fixed, a link 43 having one end connected to the rotational shaft 42, a slide member 44 rotatably connected to the link 43, and a coil spring 45 (refer to FIG. 9 and FIG. 10) as an elastic member provided in the slide member 44. FIGS. 9, 10, 11, and 12A are so depicted that the sheet storage section 21 of the sheet-feeding cassette 20 are omitted for easy understanding of cooperation of the locking portion 33, the locked portion 46, the coil spring 45, and the slide member 44. Actually, as shown in FIG. 12B, an end portion 45A of the coil spring 45 is in contact with a rib 21R projecting in a lateral direction from a wall member 21V of the sheet accommodating portion 21 of the sheet-feeding cassette 20, and the other opposite end portion (not shown) of the coil spring 45 is accommodated and retained in a compressed state in a recessed portion of a spring retaining portion 44*a* of the slide member 44. This coil spring 45 normally urges the slide member 44 in an accommodating direction (a direction of arrow in FIG. 9) of the sheet-feeding cassette 20. The rotational shaft 42 is so supported by an unillustrated supporting member that the rotational shaft 42 can be rotated in forward and rearward directions inside the sheet-feeding cassette 20. Further, the slide member 44 is provided with the locked portion 46 which falls in a locked state or unlocked state with respect to the locking portion 33.

As shown in FIG. 8, when the grip portion 26 is gripped, the front long side portion 28*a* of the unlocking unit 40 moves forward, and the rotational shaft 42 is rotated in an arrow direction via the link 41. This rotation of the rotational shaft 42 allows the link 43 to move so that the slide member 44 moves in an arrow direction (forward direction). Accordingly, the locked portion 46 pushes the locking portion 33 and is detached to fall in the unlocked state.

On the other hand, when gripping of the grip portion 26 is loosened, or a hand is released from the grip portion 26, an elastic force of the coil spring 45 moves the front long side portion 28*a* rearward, and the rotational shaft 42 is rotated in a direction opposite to the arrow direction via the link 41. The rotation of the rotational shaft 42 moves the link 43, so that the slide member 44 moves in a direction opposite to the arrow direction (rearward direction). Accordingly, an elastic force allows the locking portion 33 to project outward, so that the locked portion 46 is locked by the locking portion 33.

Then, if the grip portion 26 is pulled toward the front side when the locked portion 46 is detached from the locking portion 33 to be in the unlocked state, the sheet-feeding cassette 20 is drawn from the cassette accommodating section 30 by sliding. At this time, a force for unlocking and a drawing force are required at different timings. Then, the drawing motion allows the sheet accommodating portion 21*a* to appear.

When the sheet P is supplied to the sheet accommodating portion 21*a*, and a user pushes the sheet-feeding cassette 20 rearward to accommodate the sheet-feeding cassette 20 to the cassette accommodating section 30, the locked portion 46 pushes the locking portion 33 and passes through the locking portion 33, so that the locked portion 46 is locked by the locking portion 33. This locking operation sets the sheet-feeding cassette 20 to the cassette accommodating section 30. The configurations of the lower sheet-feeding cassette 20 and the lower cassette accommodating section 30 are the same as those of the upper cassette accommodating section and the upper sheet-feeding cassette.

Thus, according to the image forming apparatus in accordance with the first embodiment, timings at which the force for unlocking and the drawing force are required are different from one another. Accordingly, a large amount of force is not required at a time of drawing the sheet-feeding cassette 20. Further, slowly moving back the movable grip portion prevents occurrence of a loud sound at a time of unlocking.

As described above, the coil spring 45 is so mounted that it expands and contracts in cooperation with unlocking operation of the unlocking unit 40 to apply an elastic force for changing the state of the movable grip portion 28 from the fitted state to the projecting state. Accordingly, even when an excessive load is applied from outside to the movable grip portion 28, the movable grip portion 28 can be protected.

In the above-described first embodiment, two sets of sheet-feeding cassette 20 and cassette accommodating section 30 are provided. However, the present invention is not limited to this, and it may be applied to an image forming apparatus having only one set or more than three sets of sheet-feeding cassette 20 and cassette accommodating section 30, similarly.

Second Embodiment

Figure 13:
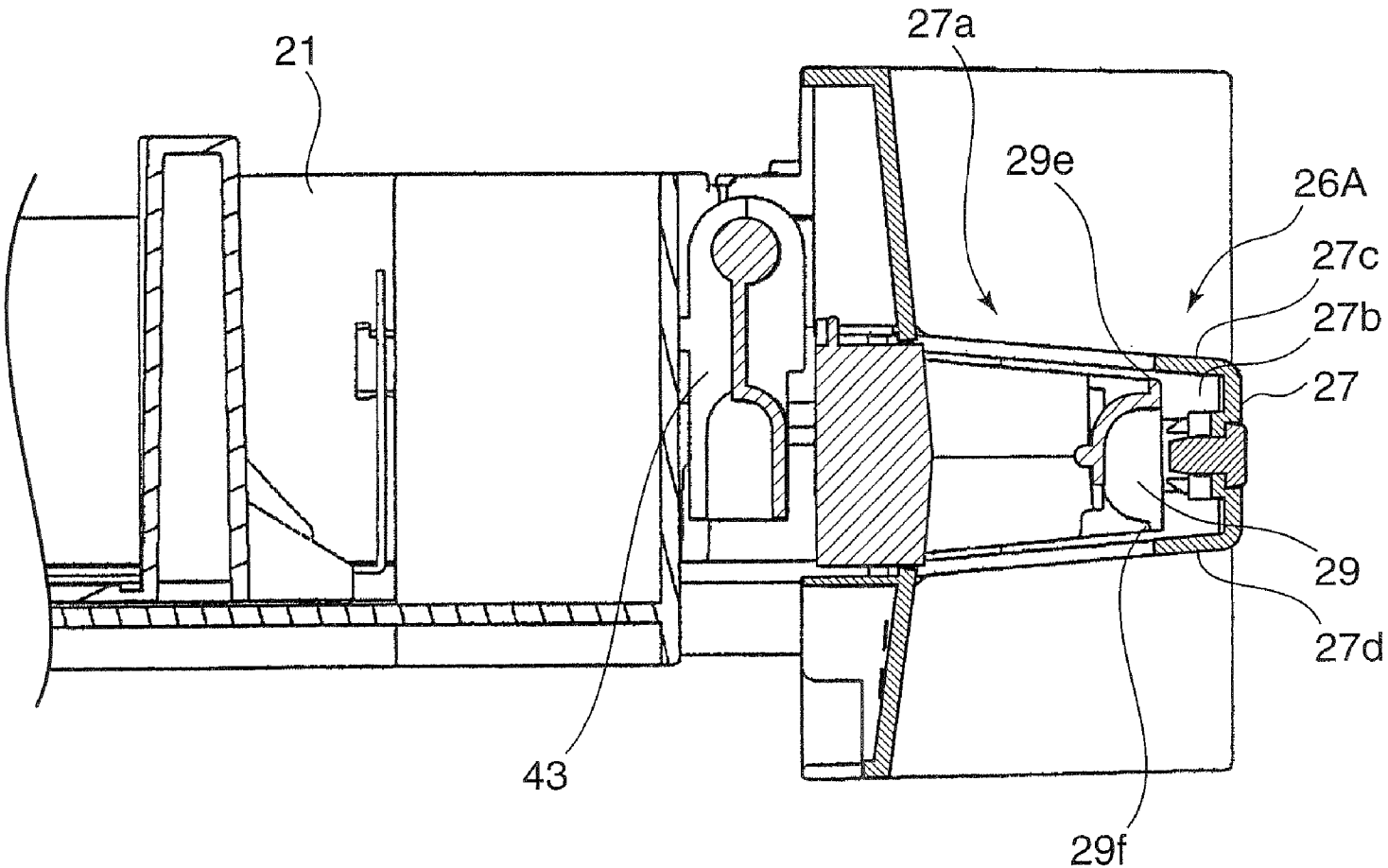
FIG. 13 is a sectional view showing a grip portion of a handle in accordance with a second embodiment of the present invention, and shows a state where the grip portion is released.
Figure 14:
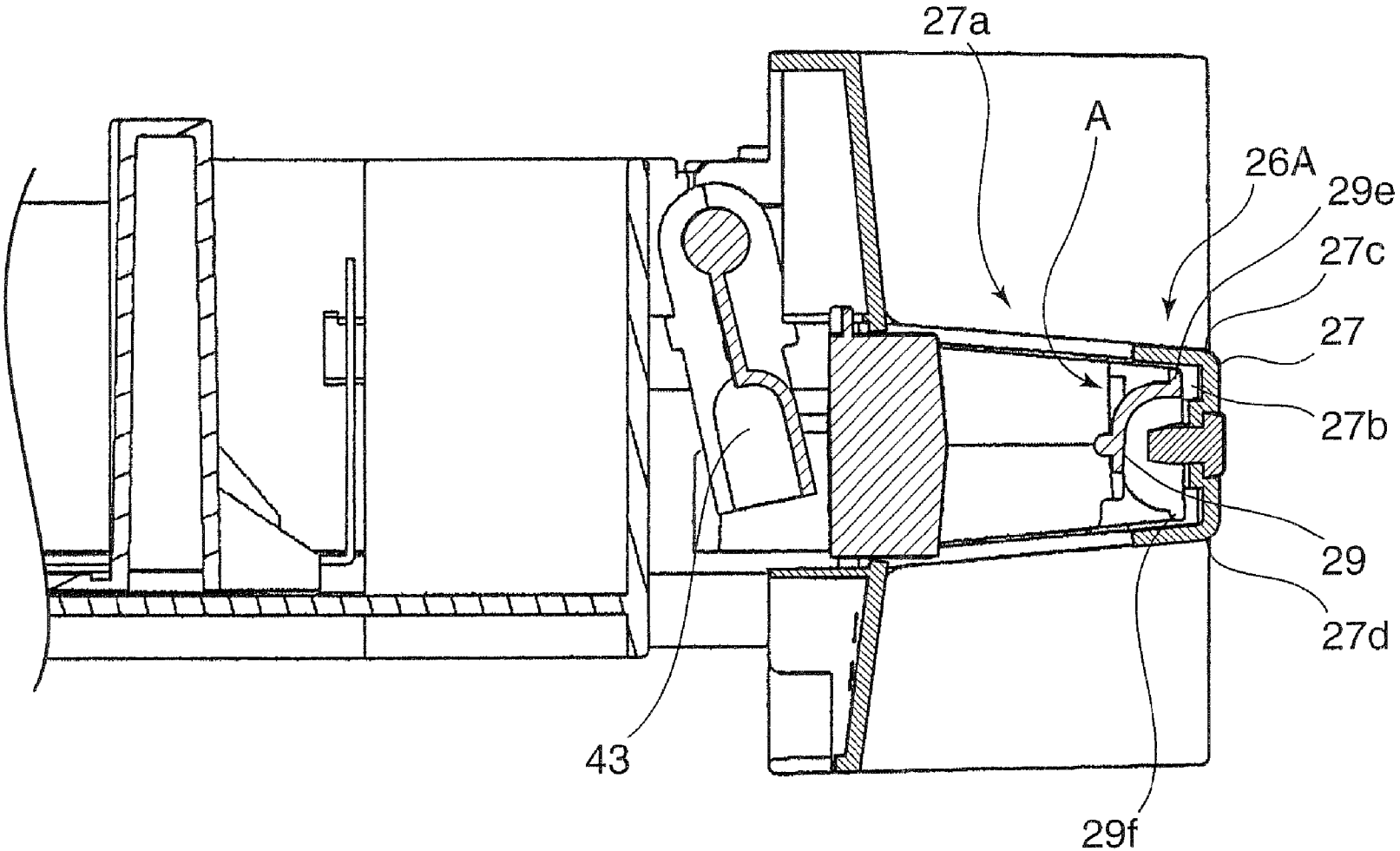
FIG. 14 is a sectional view showing the grip portion of the handle in accordance with the second embodiment of the present invention, and shows a state where the grip portion is gripped.

FIGS. 13 and 14 are sectional views showing a grip portion of a handle in accordance with a second embodiment of the present invention. FIG. 13 shows a state where the grip portion is released. FIG. 14 shows a state where the grip portion is gripped. Other parts have configurations which are the same as those of the first embodiment.

A grip portion 26A of the second embodiment includes a fixed grip portion 27 having a configuration which is the same as that of the first embodiment, but it includes a movable grip portion 29 having a configuration which is different from that of the movable grip portion 28 of the first embodiment.

The movable grip portion 29 is different from the movable grip portion 28 of the first embodiment on the following points. In other words, in the movable grip portion 28 of the first embodiment as shown in FIGS. 6 and 7, end portions 28*e*, 28*f* which come close to a pair of projecting pieces 27*c*, 27*d* arranged across the opening recess 27*b* of the fixed grip portion 27 are positioned on outer side (rear side) than respective leading ends (rear ends) of the projecting pieces 27*c*, 27*d*, and an extremely small clearance B (refer to FIG. 6) is formed between the respective leading ends (rear ends) of the projecting pieces 27*c*, 27*d* and the movable grip portion 28.

On the other hand, in the movable grip portion 29 of the second embodiment, end portions 29*e*, 29*f* which come close to the pair of projecting pieces 27*c*, 27*d* are positioned on inner side (front side) than the leading ends (rear ends) of respective projecting pieces 27*c*, 27*d*. More in detail, each of the end portions 29*e*, 29*f* has a predetermined width dimension along a vertical direction, and the movable grip portion 29 is so shaped as to extend from the respective sides of the end portions 29*e*, 29*f* apart from the projecting pieces 27*c*, 27*d* to an intermediate position between the projecting pieces 27*c*, 27*d* and project toward the opening 27*a*, so that a large clearance A (refer to FIG. 14) is formed between the leading ends (rear ends) of the projecting pieces 27*c*, 27*d* and the movable grip portion 29. It should be understood that a vicinity of a lower side of the end portion 29*f* is partially notched off.

Figure 15:
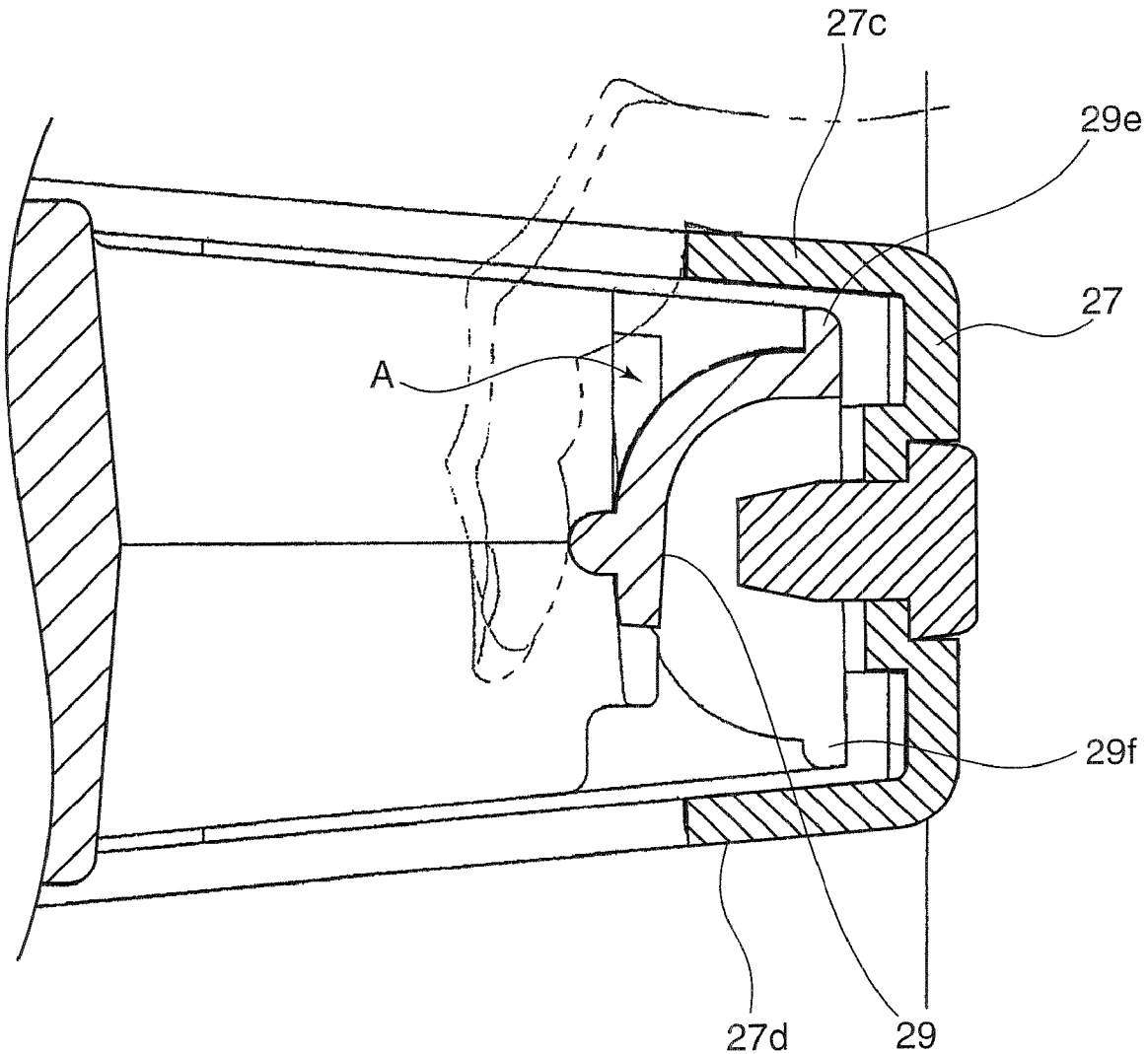
FIG. 15 is a sectional view showing a state where the grip portion of the handle in accordance with the second embodiment of the present invention is gripped.
Figure 16:
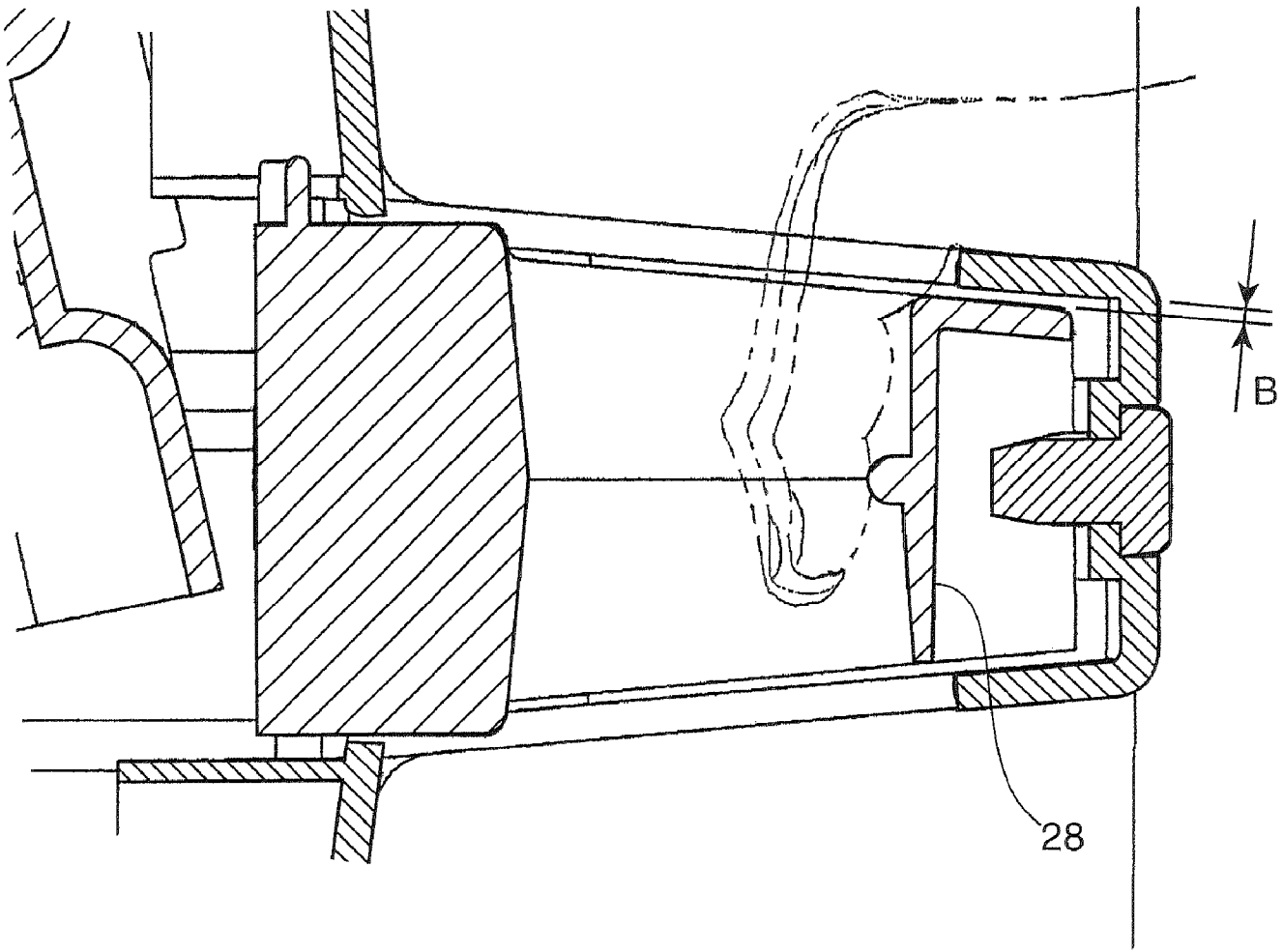
FIG. 16 is a sectional view showing a state where the grip portion of the handle in accordance with the first embodiment of the present invention is gripped.

Thus, in the case of using the movable grip portion 28 of the first embodiment, such a small clearance B like the one shown in FIG. 16 is formed, so that a user's finger is likely to be pinched by the clearance B. In the case of using the movable grip portion 29 of the second embodiment is used, such a large clearance A like the one shown in FIG. 15 can be formed, so that it can eliminate possibility that a user's finger is pinched by the clearance A.

Third Embodiment

Figure 17:
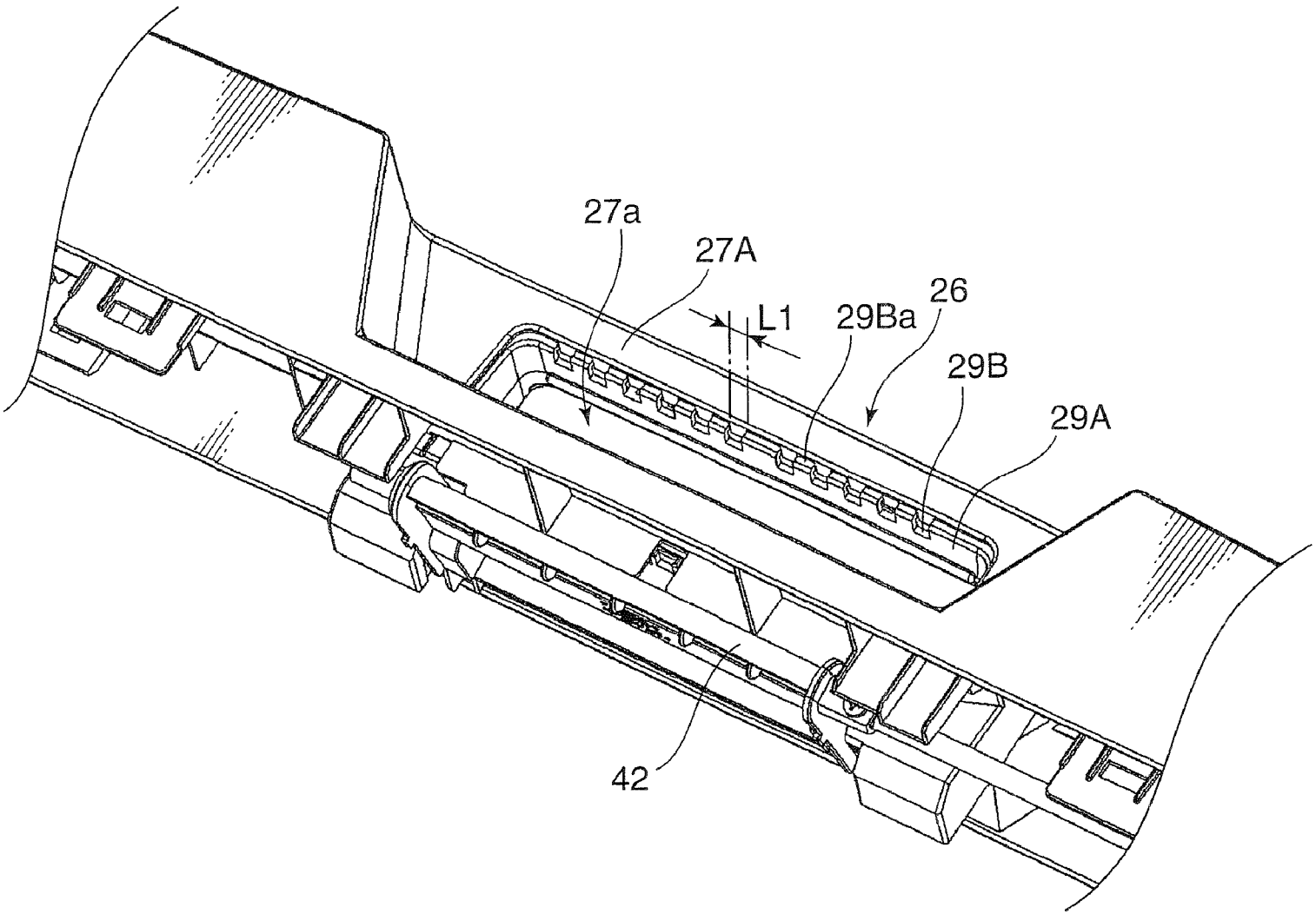
FIG. 17 is a perspective view showing a grip portion of a handle in accordance with a third embodiment of the present invention.
Figure 18:
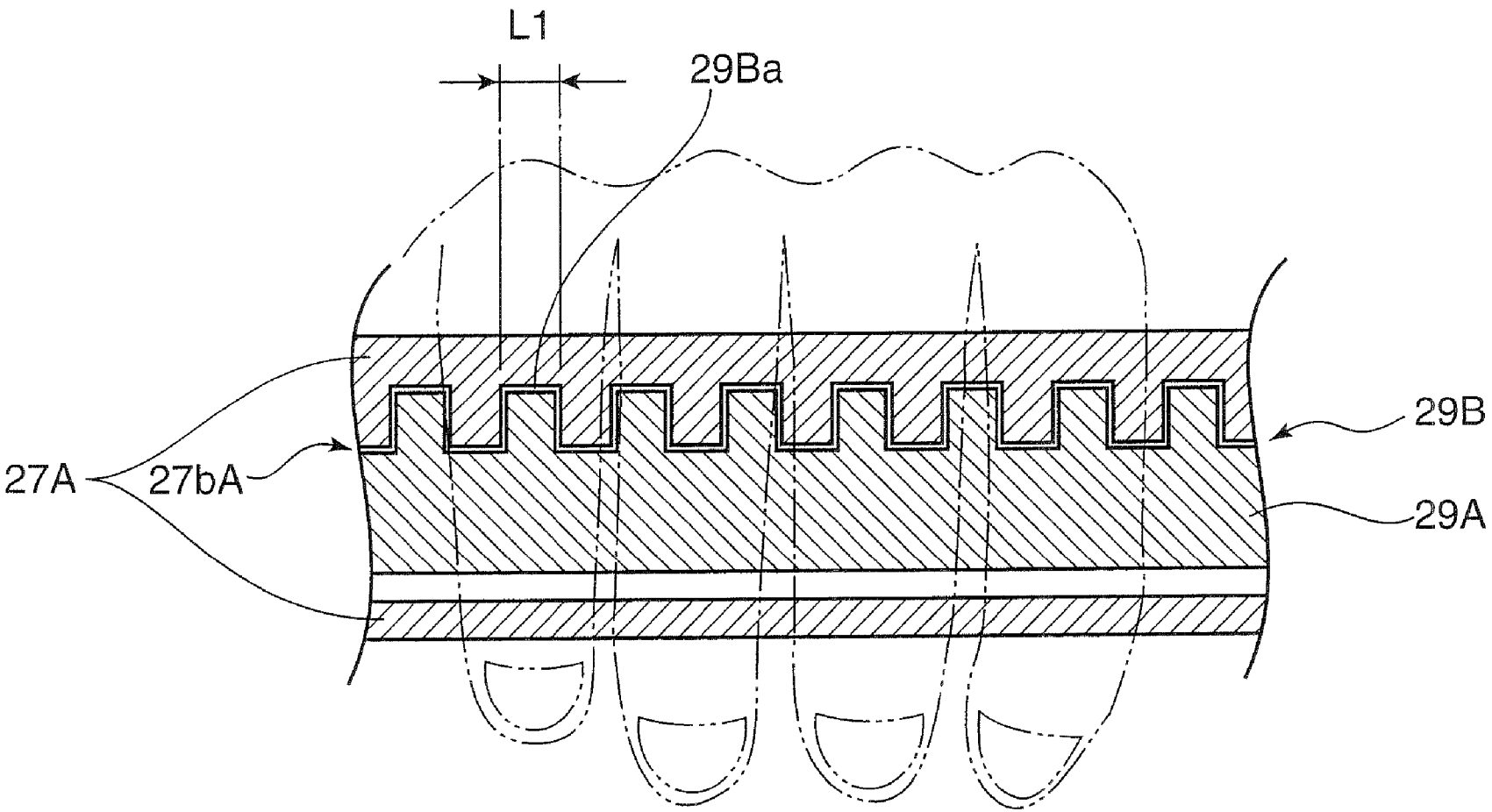
FIG. 18 shows an opening recess of the grip portion of the handle in accordance with the third embodiment of the present invention.

FIG. 17 is a perspective view showing a grip portion of a handle in accordance with a third embodiment. FIG. 18 shows an opening recess 27*b* of the grip portion. The portion hatched with lines rising rightward shows a fixed grip portion, and the portion hatched with lines rising leftward shows a movable grip portion. Further, other parts have configuration s which are the same as those of the first embodiment.

An upper end of an opening recess 27*b*A of the fixed grip portion 27A is so formed as to be irregular in a direction intersecting a slide direction of the movable grip portion 29A. On the other hand, an upper surface of the movable grip portion 29A is so formed as to be irregular in a direction intersecting the slide direction. A positional relationship of the irregularity is so arranged that the recessed portions in the upper end of the opening recess 27*b*A correspond to the projecting portions of the upper surface of the movable grip portion 29A, and the projecting portions in the upper end of the opening recess 27*b*A correspond to the recessed portions of the upper surface of the movable grip portion 29A.

Thus, according to the third embodiment, a border surface 29B between the projecting pieces on the upper side of the fixed grip portion 27A and the movable grip portion 29A is so formed as to be irregular in a direction intersecting a slide direction of the movable grip portion 29A. Accordingly, since sides 29Ba, which are adjacent to each other in a horizontal direction which is perpendicular to a longitudinal direction (vertical direction) of fingers, of the border surface 29B are apart in the longitudinal direction of the fingers, the fingers can be prevented from being pinched. At this time, a length L1 of each of the side 29Ba of the border surface 29B in a horizontal direction perpendicular to the longitudinal direction of the fingers is preferably set to be short, for example, equal to or less than 3 mm.

In the above-described first through third embodiments, the unlocking unit 40 including the pair of link 41, the rotational shaft 42, the link 43, the slide member 44, and the coil spring 45 is used. However, the present invention is not limited to this. For example, the slide member 44 can be directly connected to the movable grip portions 28, 29, 29A, and the movable grip portion 28, 29, 29A which is moved forward may be pulled back by the coil spring 45.

Further, in the above-described first through third embodiments, the sheet feeding cassette is applied to an monochromatic image forming apparatus. However, the present invention is not limited to this. The present invention may be similarly applied to the case of providing the sheet-feeding cassette to a color image forming apparatus.

In summary, a sheet-feeding cassette in accordance with an aspect of the present invention is slidably provided in a cassette accommodating section of an image forming apparatus, and set by being inserted in an insertion direction toward the cassette accommodating section, and supplied with a sheet by being drawn out of the cassette accommodating section in a drawing direction which is opposite to the insertion direction, and the sheet-feeding cassette comprises: a sheet-feeding cassette main body drawn out in the drawing direction so that the sheet is supplied; a locked portion for allowing the sheet-feeding cassette main body to be locked to a locking portion provided in the cassette accommodating section by insertion of the sheet-feeding cassette main body to the cassette accommodating section; an unlocking unit for detaching the locked portion locked to the locking portion when the sheet-feeding cassette main body is drawn out of the cassette accommodating section; a handle provided at a downstream end of the sheet-feeding cassette main body in the drawing direction, the handle including: a grip portion which is to be gripped by a user with a hand; the grip portion having: a fixed grip portion having an open recess which is open to the insertion direction and having a "]" shaped cross section; and a movable grip portion so provided as to be slidable to a fitted state of being fitted in the opening recess of the fixed grip portion when the grip portion is gripped, and to a projecting state of partially projecting from the opening recess when gripping of the grip portion is loosened or released. The unlocking unit operates for unlocking in accordance with changing of states of the movable grip portion from the projecting state to the fitted state.

In a case of the sheet-feeding cassette and the image forming apparatus so configured as described above according to an aspect of the present invention, the movable grip portion slides from the projected state of partially projecting from the opening recess of the fixed grip portion to the fitted state of being fitted in the opening recess when the grip portion of the handle is gripped. In accordance with the sliding, the unlocking unit is activated so that the locked portion falls into an unlocked state with respect to the locking portion provided in the cassette accommodating section. Accordingly, unlocking is completed. Thereafter, if a drawing force is applied to the sheet-feeding cassette, the sheet-feeding cassette is drawn. Therefore, since respective timings of applying a force needed for unlocking and a drawing force are different from one another, a large amount of force would not be necessary when the sheet-feeding cassette is drawn. Further, moving back the movable grip portion slowly causes a loud sound not to occur at the time of unlocking.

In the sheet-feeding cassette, it is preferable that the sheet-feeding cassette further includes an elastic member for urging the movable grip portion toward a direction of changing a state from the fitted state to the projecting state, and the elastic member cooperates with an unlocking operation performed by the unlocking unit.

According to the configuration above, the elastic member is so mounted as to cooperate with unlocking operation of the unlocking unit, an elastic force of moving back the movable grip portion from the fitted state to the projecting state. Accordingly, even when an excessive load is applied to the movable grip portion, the movable grip portion can be protected.

Further, the fixed grip portion may be so configured to include a pair of projecting pieces facing across the opening recess, and on the other hand, the movable grip portion may be so configured that an end portion which comes close to the pair of projecting pieces are positioned on a side of the fitted state than the leading end portions of the projecting pieces in the projecting state.

According to the configuration above, the end portion of the movable grip portion which comes close to the projecting piece facing of the opening recess of the fixed grip portion are positioned at inner side than the leading ends of the projecting pieces in the projecting state. Accordingly, a large clearance can be formed between the projecting pieces and the movable grip portion, so that pinching of fingers can be prevented.

Further, a border surface between the fixed grip portion and the movable grip portion may be irregularly formed in a direction intersecting a slide direction of the movable grip portion.

According to the configuration above, the border surface between the fixed grip portion and the movable grip portion are irregularly formed in a direction intersecting the slide direction of the movable grip portion. Accordingly, since the sides adjacent to each other in a direction perpendicular to the longitudinal direction of the fingers are apart in the longitudinal direction, so that pinching of fingers can be prevented. At this time, it is preferable that a length of the side in the direction perpendicular to the longitudinal direction of the fingers is set to be, for example, equal to or less than 3 mm.

An image forming apparatus may be provided which includes an image forming apparatus main body having a sheet-feeding cassette, a cassette accommodating section for slidably accommodating the sheet-feeding cassette, and a locking portion.

This application is based on Japanese Patent application serial No. 2007-085045 filed in Japan Patent Office on Mar. 28, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus with a cassette accommodating section and a sheet-feeding cassette which is slidably provided in the cassette accommodating section of the image forming apparatus, and set by being inserted in an insertion direction toward the cassette accommodating section, and supplied with a sheet by being drawn out of the cassette accommodating section in a drawing direction which is opposite to the insertion direction, the image forming apparatus comprising:

a sheet-feeding cassette main body drawn out in the drawing direction so that the sheet is supplied;

a locked portion for allowing the sheet-feeding cassette main body to be locked to a locking portion provided in the cassette accommodating section by insertion of the sheet-feeding cassette main body to the cassette accommodating section;

a first elastic member, provided in the cassette accommodating section, to bias the locking portion to engage with the locked portion to form a locked state between the locking portion and the locked portion;

an unlocking unit for detaching the locked portion locked to the locking portion when the sheet-feeding cassette main body is drawn out of the cassette accommodating section;

a handle provided at a downstream end of the sheet-feeding cassette main body in the drawing direction, the handle including:

a grip portion which is to be gripped by a user with a hand;

the grip portion having:

a fixed grip portion having an open recess which is open to the insertion direction and having a "]" shaped cross section; and a movable grip portion so provided as to be slidable to a fitted state of being fitted in the opening recess of the fixed grip portion when the grip portion is gripped, and to a projecting state of partially projecting from the opening recess when gripping of the grip portion is loosened or released; and a second elastic member to bias the movable grip portion toward a direction of changing a state from the fitted state to the projecting state, wherein the unlocking unit operates to simultaneously overcome a bias force produced by the first elastic member and a bias force produced by the second elastic member to unlock the locked state between the locking portion and the locked portion in accordance with changing of state of the movable grip portion from the projecting state to the fitted state.

2. The image forming apparatus according to claim 1, wherein a locking state of the locking portion and the locked portion is released when the movable grip portion moves from the projecting state to the fitted state against a biasing force applied by the elastic member in such a state where the sheet-feeding cassette is accommodated in the sheet-feeding cassette accommodating section.

3. The image forming apparatus according to claim 1, wherein the fixed grip portion includes a pair of projecting pieces facing across the opening recess, and the movable grip portion is so configured that, in the fitted state, an end portion on a side close to the pair of projecting pieces is positioned farther between the leading end portions of the projecting pieces than when the movable grip portion is in the projecting state.

4. The image forming apparatus according to claim 1, wherein a border surface between the fixed grip portion and the movable grip portion has an alternating arrangement of projections and recesses in a direction intersecting a slide direction of the movable grip portion.

5. An image forming apparatus which includes an image forming apparatus main body having a sheet-feeding cassette, a cassette accommodating section for slidably accommodating the sheet-feeding cassette, and a locking portion, slidably provided in a cassette accommodating section of an image forming apparatus, and set by being inserted in an insertion direction toward the cassette accommodating section, and supplied with a sheet by being drawn out of the cassette accommodating section in a drawing direction which is opposite to the insertion direction, the image forming apparatus comprising:

a sheet-feeding cassette main body drawn out in the drawing direction so that the sheet is supplied;

a locked portion for allowing the sheet-feeding cassette main body to be locked to a locking portion provided in the cassette accommodating section by insertion of the sheet-feeding cassette main body to the cassette accommodating section;

a first elastic member, provided in the cassette accommodating section, to bias the locking portion to engage with the locked portion to form a locked state between the locking portion and the locked portion;

an unlocking unit for detaching the locked portion locked to the locking portion when the sheet-feeding cassette main body is drawn out of the cassette accommodating section;

a handle provided at a downstream end of the sheet-feeding cassette main body in the drawing direction, the handle including:

a grip portion which is to be gripped by a user with a hand;

the grip portion having:

a fixed grip portion having an open recess which is open to the insertion direction and having a "]" shaped cross section; and a movable grip portion so provided as to be slidable to a fitted state of being fitted in the opening recess of the fixed grip portion when the grip portion is gripped, and to a projecting state of partially projecting from the opening recess when gripping of the grip portion is loosened or released; and a second elastic member to bias the movable grip portion toward a direction of changing a state from the fitted state to the projecting state, wherein the unlocking unit operates to simultaneously overcome a bias force produced by the first elastic member and a bias force produced by the elastic member to unlock the locked state between the locking portion and the locked portion in accordance with changing of states of the movable grip portion from the projecting state to the fitted state.

* * * * *